United States Patent [19]

Vakil

[11] 4,285,203

[45] Aug. 25, 1981

[54] MEANS AND METHOD FOR SIMULTANEOUSLY INCREASING THE DELIVERED PEAK POWER AND REDUCING THE RATE OF PEAK HEAT REJECTION OF A POWER PLANT

[75] Inventor: Himanshu B. Vakil, Schenectady, N.Y.

[73] Assignee: General Electric Company, Schenectady, N.Y.

[21] Appl. No.: 87,972

[22] Filed: Oct. 25, 1979

[51] Int. Cl.[3] ..... F01K 23/04

[52] U.S. Cl. ..... 60/652; 60/655

[58] Field of Search ..... 60/652, 655, 659

[56] References Cited

U.S. PATENT DOCUMENTS

| | | | |
|---|---|---|---|
| 3,886,749 | 6/1975 | Pacault | 60/652 |
| 3,998,695 | 12/1976 | Cahn et al. | 60/659 X |
| 4,003,786 | 1/1977 | Cahn | 60/659 X |
| 4,158,385 | 6/1979 | Vandenhoeck | 165/107 X |

*Primary Examiner*—Allen M. Ostrager

*Attorney, Agent, or Firm*—Robert R. Schroeder; James C. Davis, Jr.; Paul R. Webb, II

[57] ABSTRACT

A power plant includes a primary and a secondary power cycle, with the secondary power cycle including a thermal reservoir adapted for the absorption of heat rejected from the primary power cycle during the simultaneous generation of power from the secondary power cycle. Heat is withdrawn from the thermal reservoir during periods of reduced power demand, allowing latitude in the scheduling of heat rejection from the power plant.

10 Claims, 2 Drawing Figures

MEANS AND METHOD FOR SIMULTANEOUSLY INCREASING THE DELIVERED PEAK POWER AND REDUCING THE RATE OF PEAK HEAT REJECTION OF A POWER PLANT

BACKGROUND OF THE INVENTION

This invention relates generally to energy storage for the load leveling of power plants, and more particularly to load leveling storage schemes which simultaneously reduce the rate of peak heat rejection of an associated power plant.

The demand for electricity from a power system typically varies between a given base load and a higher peak rate. To accommodate this varying demand electrical power systems have historically operated their most efficient power plants in a constant "base loaded" mode and have added additional power plants to the system power grid as demand increases in order of decreasing power plant efficiency, with the least efficient plant being the last added.

More recently, load leveling systems involving the storage of energy have been introduced as a means of avoiding the use of less efficient power plants during periods of peak power demand, as well as to allow existing power plants to operate in the efficient "base loaded" mode while avoiding the addition of costly new peaking power plants. These load leveling systems typically involve the storage of energy (mechanical, electrical or thermal) in some reservoir during off-peak hours and withdrawing it during hours of greater need. The scarcity of suitable sites for pumped hydro-storage schemes and the projected high cost of electrical storage has resulted in a growing interest in thermal storage.

Conventional thermal storage systems include steam storage, hot water storage, and thermal storage in hot oil reservoirs. However, each of these conventional thermal storage systems requires that the stored thermal energy be withdrawn and converted to a useable form of energy during periods of peak power demand, thereby resulting in an increase in the peak heat rejection rate of the associated power plant.

The accommodation of this increased rate of peak heat rejection typically requires the construction and use of additional plant capacity to transfer the rejected heat to a heat sink. This additional capacity may be in the form of larger cooling towers, spray ponds, or the like. As a result, power plant construction, operating and maintenance costs are all significantly increased in power plants utilizing conventional thermal storage systems.

Accordingly, it is an object of the present invention to provide a new and improved method and system for increasing the deliverable peak power of a power plant while simultaneously reducing the rate of heat rejection typically associated with peak power production.

Thus, through the practice of the present invention a power plant intended to meet a given peak load can be designed with a primary power cycle having an output below the intended plant peak power output. Similarly, such a plant could include a rejected heat transfer capacity less than that required for a typical power plant of equal design peak power output, especially if compared to a power plant employing a conventional thermal storage system. Accordingly, the savings in capitol costs as well as in operating and maintenance costs resulting from the practice of the present invention are significant. Of course, it is appreciated that these benefits are not limited to electrical power systems, and that similar savings are obtainable with other power plants operating to satisfy variable power demands.

SUMMARY OF THE INVENTION

The above and other objects and advantages are achieved in a power plant comprising a primary and a secondary power cycle, with the secondary power cycle including a thermal reservoir adapted for the absorption of heat rejected from the primary power cycle during the simultaneous generation of power from the secondary power cycle. Heat is withdrawn from the thermal reservoir during periods of reduced power demand, allowing latitude in the scheduling of heat rejection from the power plant. In a preferred embodiment of the invention the primary power cycle includes a conventional heat storage system of suitable capacity to provide the delivery of increased peak power from the primary power cycle while enabling the maintenance of a substantially constant rate of heat rejection for the power plant as a whole and allowing the basic power producing segment of the primary power cycle to operate in a constant or "base load" mode.

BRIEF DESCRIPTION OF THE DRAWING

For a better understanding of the invention, reference may be had to the accompanying drawing wherein.

DESCRIPTION OF THE INVENTION

Figure 1:
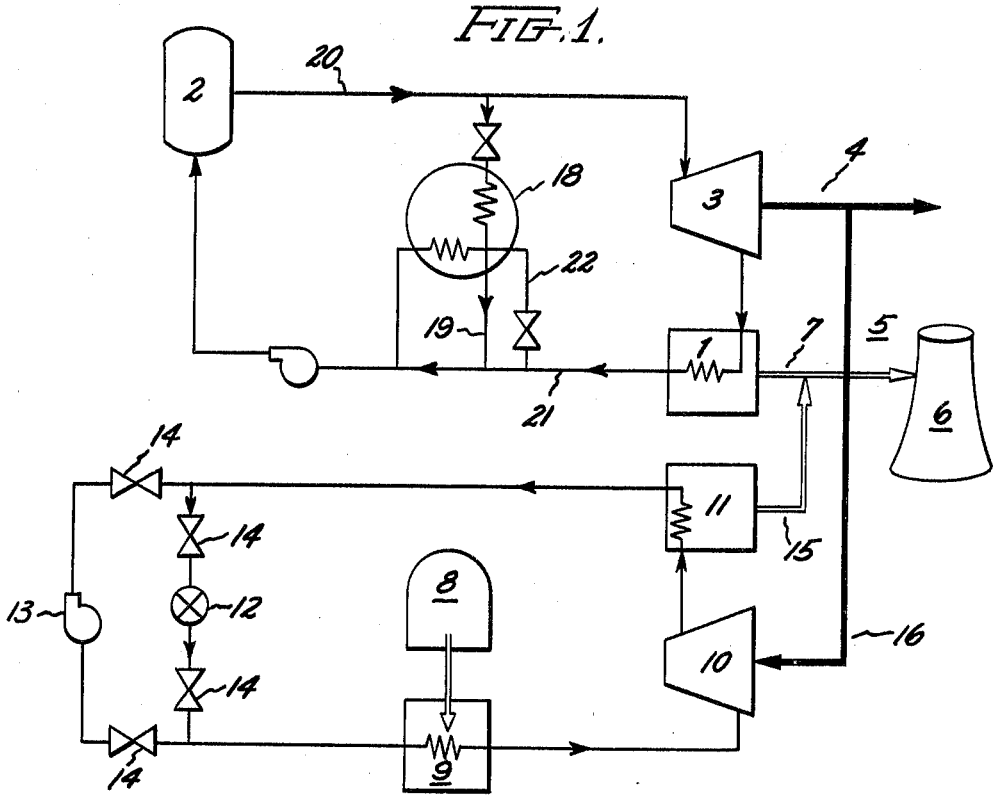
FIG. 1 is a schematic illustration of a power plant employing the present invention and operating during a period of decreased power demand.

As illustrated in FIG. 1 the primary power cycle includes a conventional steam power cycle in which feed water flows from a condenser 1 and enters a steam generator 2 in which the feed water is converted to steam. The steam is then conveyed in a steam line to an expansion turbine 3 wherein useful power is produced as depicted at 4. The turbine exhaust is returned to the condenser 1 to complete the steam power cycle. The heat of condensation is transferred from the condenser 1 and is rejected to an appropriate heat sink through the utilization of conventional means 5. In the exemplary system depicted in FIG. 1 this means 5 to reject heat to a heat sink includes a cooling tower 6 and a cooperating closed loop cooling water line 7 disposed in heat exchange relationship with both the condenser 1 and with the atmosphere.

Figure 2:
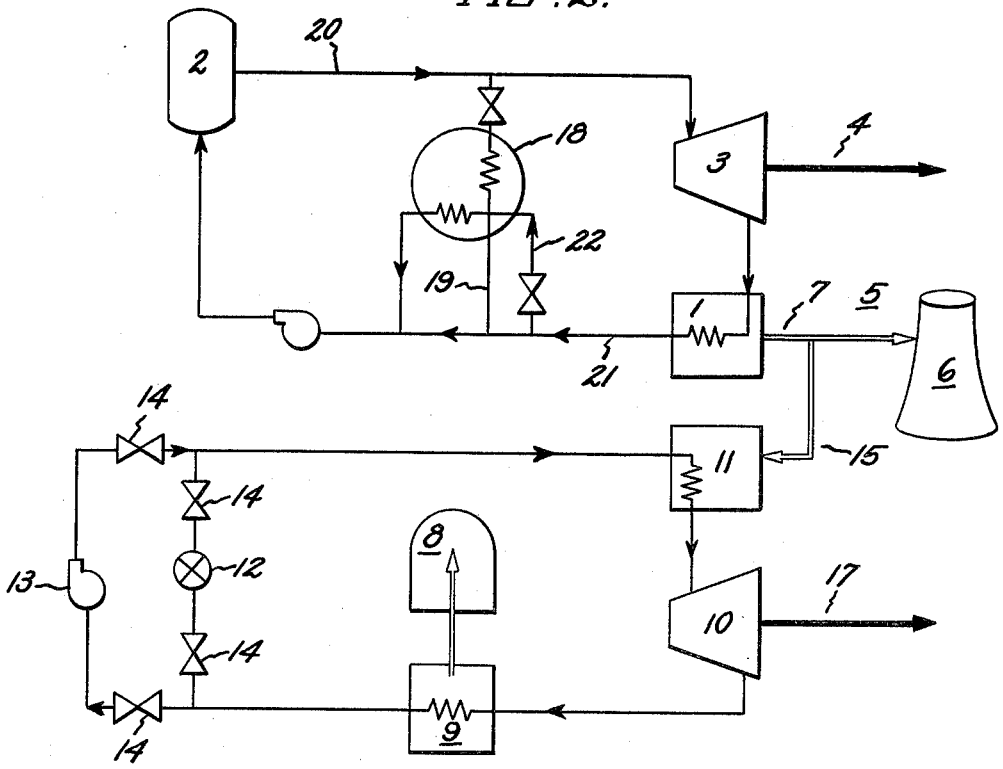
FIG. 2 is a schematic representation of the power plant system of FIG. 1 operating during a period of peak power demand.

The secondary power cycle as depicted in FIGS. 1 and 2 comprises a conventional, reversible vapor compression cycle device disposed in heat exchange relationship with a thermal reservoir 8 and with the means 5 for rejecting heat from the primary cycle. More specifically, the reversible vapor compression cycle device of the secondary power cycle includes a first heat exchanger 9 connected in series flow communication with a reversible turbine means 10 and a second heat exchanger means 11. In the heat withdrawal mode of the secondary power cycle as depicted in FIG. 1, the reversible vapor compression cycle is completed by an expansion device 12 connected intermediate the first and second heat exchanger means 9 and 11. In the power producing mode of the secondary power cycle as depicted in FIG. 2, the reversible vapor compression cycle is completed by a pump means 13 similarly connected intermediate the first and second heat exchanger means 9 and 11, respectively. Valves 14 are provided to isolate the expansion device 12 or the pump means 13 as appropriate based on the selected operating mode of the secondary power cycle.

As illustrated in both FIGS. 1 and 2, the first heat exchanger means 9 is disposed in heat exchange relationship with the thermal reservoir 8. The thermal reservoir is capable of accepting and giving up thermal energy at a temperature significantly below the normal rejection temperature of the primary power cycle. Accordingly, in a preferred embodiment the thermal reservoir of the present invention is a latent heat storage device utilizing phase transition materials. Exemplary systems include a water/ice system (32° F.), a $Na_2SO_4$/-NaCl/K Cl/$H_2O$ system (40° F.), and a water clathrate system. The secondary power cycle is also provided with a means 15 to enable a heat exchange relationship between the means 5 of the primary power cycle for rejecting heat and the second heat exchanger means 11 to thereby transfer heat into and out of the secondary power cycle.

In operation during periods of reduced power demand as illustrated in FIG. 1 power is produced in the primary power cycle as depicted at 4, with heat being rejected from the system to the atmosphere through the means 5. A portion of the power produced by the primary power cycle may be used in this mode to operate the secondary power cycle as depicted at 16 to enable heat to be withdrawn from the thermal reservoir 8.

More specifically, during periods of reduced power demand heat is withdrawn from the thermal reservoir 8 by heat transfer to a working fluid flowing through the first heat exchanger means 9 where at least a portion of the fluid is vaporized. The resultant vapor is then compressed in the reversible turbine means 10 and condensed in the second heat exchanger means 11. The condensate is then circulated through the expansion device 12 and conveyed back to the first heat exchanger means 9 to repeat the cycle. The pumping means 13 is isolated by suitable adjustment of the valves 14 in this mode of operation. The heat of condensation is removed from the second heat exchanger means 11 by the heat transfer means 15 and is rejected to a suitable heat sink through cooperation with the means 5 for rejecting heat.

During periods of peak power demand, the primary power cycle operates in a mode similar to that described above for periods of reduced power demand. In the secondary power cycle, however, power is produced while absorbing at least a portion of the heat rejected from the primary power cycle.

In particular, in the process depicted in FIG. 2, thermal energy is recovered from the rejected heat of the primary cycle through heat exchange between the means 5 for rejecting heat and the means 15 for heat transfer to the secondary power cycle. The recovered heat is transferred to the second heat exchanger means 11 where it is employed to evaporate the working fluid contained in the associated reversible vapor compression cycle. The vapor exiting the second heat exchanger means 11 are expanded in the reversible turbine 10 to produce additional peak delivered power for the power plant as depicted at 17. The low pressure vapor exhausted from the turbine 10 is condensed in the first heat exchanger means 9, with the condensation heat being rejected to the thermal reservoir 8. The resultant condensed working fluid is pumped by means 13 back to the second heat exchanger means 11 to complete the reversible vapor compression cycle when operating in the power producing mode. The expansion device 12 is isolated by adjusting the valves 14 in this mode of operation.

In a preferred embodiment of the present invention, the primary power cycle also includes a reversible high temperature storage segment 18. This high temperature storage segment may be a conventional thermal storage system as described hereinabove disposed during those periods of reduced power demand in heat exchange relationship with a flow of working fluid 19 diverted from a high temperature steam line 20 to a low temperature feed-water line 21. The high temperature storage segment 18 may also be beneficially disposed during periods of peak power demand in heat exchange relationship with a flow of feed water diverted from the feed-water line 20 in a line 21.

In operation during periods of reduced power production, line 22 is typically isolated by valving and a portion of the steam generator 2 output is diverted through the line 19 to provide thermal energy to the high temperature storage segment 18. The remainder of the steam generator output is sent to the steam turbine 3 to generate useful work. The net effect of such an operation is the production of a small amount of net work as depicted at 4, the charging of thermal energy into the high temperature thermal storage segment 18, and the extraction of thermal energy from the thermal reservoir 8.

In operation during periods of peak power demand as illustrated in FIG. 2, the line 19 is isolated and the line 22 is opened. Thus the thermal energy stored in the high temperature storage segment 18 is used for feed-water preheat through heat transfer with the feed water conveyed through the line 21. Alternatively, the thermal energy stored in the storage segment 18 can be employed in other conventional systems not here illustrated or described to generate additional high pressure steam or to provide thermal energy for a separate power producing system. In the system illustrated in FIG. 2, no steam is diverted from the steam line 19 to the thermal storage segment 18 during periods of peak power demand, and the total steam flow from the steam generator 2 is expanded in the turbine 2.

A portion of the condensation heat from the condenser 1 is sent to the cooling towers 6 while the remainder is transferred to the second heat exchanger means 11 of the secondary power system by the means 15. The vapor exhausted from the second heat exchanger 11 are expanded in the turbine 10 to produce additional work as depicted at 17. The low pressure vapor from the turbine exhaust is condensed in the first heat exchanger means 9, with the condensation heat being rejected to the thermal reservoir 8. The resultant condensed working fluid liquid is pumped by the pump means 13 back to the second heat exchanger 11 to complete the reversible vapor compression cycle of the secondary power cycle.

The net effect of this operation in periods of peak power demand is the production of relatively large amounts of power by the two turbines (3 and 10) to supply peak power demand, a depletion of the stored thermal energy in the high temperature storage segment 18, and the reheating of the thermal reservoir 8 to its original state prior to the period of reduced power production. It should be noted that the cooling tower 6 has to reject only a portion of the condensation heat from the condenser 1 during this period of peak power demand.

By suitable choices of steam output from the steam generator 2, the amount of thermal storage in the high temperature storage segment 18, and the thermal capacity of the thermal reservoir 8, it is possible to satisfy a design peak power demand, and an off-peak power demand, and at the same time to vary the relative heat rejection rates of the power plant both during peak and off-peak hours.

The following equations and the subsequent example will illustrate this point in greater detail. The equations representing the energy flows during off-peak and peak hours include the following nomenclature:

- $Q_S$: constant base load heat rate for steam generator 2
- $Q_H$: rate of heat input to high temperature storage segment 18 during off-peak periods
- $Q_C$: rate of heat withdrawal from thermal reservoir 8 during off-peak periods
- $\eta_S$: basic primary power cycle efficiency using steam generator 2 alone
- $\eta_H$: incremental primary power cycle efficiency of using heat from high temperature storage segment 18
- $\eta_R$: secondary power cycle efficiency during off-peak periods (work per unit heat extracted from thermal reservoir 8)
- $\eta_B$: secondary power cycle efficiency during peak periods (work per unit heat rejected to thermal reservoir 8)
- $\alpha$: fraction of daily hours during peak

Off-Peak Operation

Total work produced $=(Q_S-Q_H)\eta_S$

Secondary cycle work input $=Q_C\eta_R$

Net power plant work during off-peak $=(Q_S-Q_H)\eta_S-Q_C\eta_R$ (1)

Total power plant heat rejection duty $=(Q_S-Q_H)(1-\eta_S)+Q_C(1+\eta_R)$ (2)

Operation During Peak Hours

Rate of heat extraction from high temperature storage segment 17 =

$$\frac{(1-\alpha)}{\alpha}Q_H$$

Work from primary power plant steam cycle =

$$Q_S\eta_S+\frac{(1-\alpha)}{\alpha}Q_H\eta_H$$

Total power plant work including secondary power cycle =

$$Q_S\eta_S+\frac{(1-\alpha)}{\alpha}Q_H\eta_H+\frac{(1-\alpha)}{\alpha}Q_C\eta_B \quad (3)$$

Total power plant heat rejection duty =

$$Q_S(1-\eta_S)+\frac{(1-\alpha)}{\alpha}Q_H(1-\eta_H)-\frac{(1-\alpha)}{\alpha}Q_C(1+\eta_B) \quad (4)$$

Equations 1–4 describe the total power plant work and reject heat duties with three design parameters—$Q_S$, $Q_H$ and $Q_C$. By a proper selection, it is possible to meet the required peak and off-peak electrical demand, and in addition to control the rate of heat rejection during peak periods relative to that during off-peak periods. One embodiment would make the two equal to each other, thereby operating the cooling towers 6 at a constant design rate. Another embodiment would exploit the lower nighttime temperatures and reject a higher amount during that period than during the peak daytime demand period. This second embodiment would be particularly beneficial for power plants using dry cooling towers in dry, desert climates due to characteristic desert climatic conditions.

The following example will demonstrate the application to a power plant required to deliver four times as much power during peak-hours as during off-peak hours. The objective is to baseload the cooling towers. The following parameters have been assumed:

$$\eta_S=0.33;\ \eta_H=0.30;\ \alpha=0.5$$

$$\eta_R=0.20;\ \eta_B=0.128$$

For equal rejection duty, the following relation is obtained:

$$0.67Q_S-0.67Q_H+1.2Q_C=0.67$$
$$Q_S=0.70Q_H-1.128Q_C$$

therefore $$Q_C/Q_H=0.588 \text{ for equal reject duties}$$

The required ratio of peak to off-peak demand can be met if $$0.33Q_S+0.3Q_H+0.128Q_C=4(0.33Q_S-0.33Q_H-0.2Q_C)$$

or $$0.33Q_S+0.375Q_H=4(0.33Q_S-0.448Q_H)$$

the result is $$Q_H/Q_S=0.457$$

Thus, for this power plant the storage requirements are 45.7% of baseload heat rate transferred into the high temperature storage segment 17 coupled with 26.9% of baseload heat rate out of the thermal reservoir 8 during off-peak hours.

It is noteworthy that in the absence of the present invention, the required high temperature storage segment capacity would be 61.1% of baseload heat rate. Of greater interest however, the ratio of heat rejection duties during peak and off-peak hours would be 4.23. Accordingly, a power plant using the present invention would need cooling towers with a capacity only 62% of that for the power plant without the present invention. The advantage offered by this invention would be even greater for smaller peak fractions ($\alpha<0.5$).

The above described embodiments of this invention are intended to be exemplative only and not limiting, and it will be appreciated by those skilled in the art that many substitutions, alterations and modifications may be made to the enclosed structure without departing from the spirit or the scope of the invention. In particular, it will be appreciated that the primary power cycle is not limited to a steam power cycle, nor is the secondary power cycle restricted to the use of a reversible vapor compression cycle.

What I claim as new and desire to secure by Letters Patent of the United States is:

1. A method for simultaneously increasing the delivered peak power and reducing the peak heat rejection rate of a power plant which plant produces power cyclically over time including a period of peak power production and a period of decreased power production, said power plant having a primary power cycle and a secondary power cycle, said method comprising the steps of:

generating thermal energy in said primary power cycle and rejecting a portion of said thermal energy from said primary power cycle during the production of power therein:

providing a thermal reservoir in said secondary power cycle capable of accepting thermal energy at a temperature below that of said thermal energy rejected from said primary cycle;

transferring at least a portion of said thermal energy rejected from said primary cycle during said period of peak power production to said thermal reservoir of said secondary cycle, and producing power in said secondary power cycle during said transfer; and withdrawing heat energy from said thermal reservoir during at least a portion of said period of decreased power production.

2. A method as in claim 1 wherein a portion of the thermal energy generated in said primary power cycle is accepted by a high temperature storage segment of said primary power cycle during said period of decreased power production, and at least a portion of said accepted thermal energy is withdrawn from said high temperature storage segment during said period of peak power production.

3. A method as in claim 2 wherein the acceptance and withdrawal of thermal energy in said thermal reservoir and in said high temperature storage segment are adjusted to maintain a substantially constant rate of power plant heat rejection during the production of power.

4. A power plant operating cyclically over time including a period of peak power production and a period of decreased power production having simultaneously increased delivered peak power and reduced peak heat rejection rate to a heat sink, said power plant comprising:

a primary power cycle including a means for rejecting heat to said heat sink;

a secondary power cycle including a thermal reservoir capable of accepting thermal energy at a temperature below that of said primary power cycle rejected heat, and a power producing thermal cycle in heat exchange relationship with said thermal reservoir;

means in said secondary power cycle for transferring thermal energy from said means for rejecting heat of said primary cycle to said thermal reservoir; and means in said secondary power cycle for transferring thermal energy from said thermal reservoir to said heat sink.

5. A power plant as in claim 4 wherein the power-producing thermal cycle of said secondary power cycle includes a reversible vapor compression cycle.

6. A power plant as in claim 4 wherein said primary power cycle includes a power-producing segment and a reversible high temperature storage segment disposed in heat exchange relationship with said power-producing segment.

7. As power plant as in claim 6 wherein said thermal reservoir and said high temperature storage segment are provided with sufficient thermal storage capacity to enable the maintenance of a power plant heat rejection during the period of peak power production substantially equal to the rate of power plant heat rejection during the period of decreased power production.

8. A power plant operating cyclically over time including a period of peak power production and a period of decreased power production having a simultaneously increased delivered peak power and reduced peak heat rejection rate to a heat sink, said power plant comprising:

a primary power cycle including a working fluid circuit comprising a steam generator, an expansion turbine in flow communication with said steam generator, a condensing heat exchanger in flow communication with said expansion turbine, and a means for rejecting heat to said heat sink in heat exchange relationship with said condensing heat exchanger;

a secondary power cycle including a first heat exchanger means in heat exchange relationship with said means for rejecting heat of said primary power cycle, means for transferring thermal energy from said first heat exchanger of said secondary power cycle to said heat sink, a reversible turbine means connected to said first heat exchanger, a second heat exchanger connected to said reversible turbine, a thermal reservoir in heat exchange relationship with said second heat exchanger and capable of accepting thermal energy at a temperature below the temperature of the heat rejected from said primary power cycle to said heat sink, and an expansion device and a pumping means connected intermediate said second heat exchanger and said first heat exchanger.

9. A power plant as in claim 8 wherein said primary power cycle further includes a reversible high temperature thermal energy storage segment in heat exchange relationship with said primary power cycle working fluid circuit.

10. A power plant as in claim 8 wherein the thermal reservoir in said secondary power cycle is a latent heat storage device utilizing phase transition of materials.

* * * * *